US005392577A

United States Patent [19]

D'Onofrio, Jr. et al.

[11] Patent Number: 5,392,577

[45] Date of Patent: Feb. 28, 1995

[54] DECORATIVE LOUVERED DOOR AND METHOD

[76] Inventors: Gennaro A. D'Onofrio, Jr.; Dorothy L. D'Onofrio, both of 5304 Erie Dr., Sebring, Fla. 33872

[21] Appl. No.: 172,841

[22] Filed: Dec. 23, 1993

[51] Int. Cl.[6] ..... E06B 7/08

[52] U.S. Cl. ..... 52/473; 49/74.1

[58] Field of Search ..... 52/473, 311.3; 160/236; 49/70, 74.1, 92.1

[56] References Cited

U.S. PATENT DOCUMENTS

| | | | |
|---|---|---|---|
| 4,850,138 | 7/1989 | Watanabe et al. | 49/74.1 X |
| 4,858,400 | 8/1989 | Foyt | 52/473 |
| 5,263,529 | 11/1993 | Landis | 160/236 |

*Primary Examiner*—Carl D. Friedman

*Assistant Examiner*—Creighton Smith

*Attorney, Agent, or Firm*—Charles J. Prescott

[57] ABSTRACT

A decorative louvered door and kit and method of ornamentally decorating a conventional louvered door. The louvered door includes a perimeter frame having a plurality of spaced, angled louvers extending between opposing upright margins of the frame. One or more groups of adjacent louvers include an elongated mirrored strip adhesively attached onto the outwardly facing surface of each louver in the group. An elongated beaded decorative molding is adhesively attached onto the outwardly facing surface of one or more other groups of adjacent louvers so that, in the preferred embodiment, all of the louvers are decorated in alternating groups of mirrored strips and decorative beaded moldings.

6 Claims, 3 Drawing Sheets

DECORATIVE LOUVERED DOOR AND METHOD

BACKGROUND OF THE INVENTION

1. Scope of Invention

This invention relates generally to louvered doors, and more particularly to a decorative louvered door and kit and method for decoratively transforming a conventional louvered door.

2. Prior Art

Conventional louvered doors, fabricated of either wood or molded opaque plastic components are well known. These conventional louvered doors include a perimeter frame having parallel upright margins between which are positioned a plurality of spaced, horizontal uniformly angled louvers. These louvers are spaced apart so as to allow air flow therethrough but are diagonally angled such that, when the door is viewed from any normal viewing position, the louvers are not see-through, but appear as a solid surface.

Some louvered doors take the form of louvers over their entire length, while others include a solid paneled potion between the upright frame margins as well. Either arrangement of spaced louvers, with or without solid panels between the upright margins of the frame becomes a matter of design choice.

Although such louvered doors are quite functional in allowing airflow, while inhibiting line of site viewing therethrough, nonetheless these conventional louvered doors are somewhat unornamental and applicants are unaware of any articles of manufacture or methods of decoratively enhancing the appearance of such conventional louvered doors.

The present invention provides for the decorative enhancement of conventional louvered doors by providing adhesively attachable mirrored strips and highly reflective polished bead-shaped moldings onto the outer surfaces of selected louvers.

BRIEF SUMMARY OF THE INVENTION

This invention is directed to a decorative louvered door and kit and method of ornamentally decorating a conventional louvered door. The louvered door includes a perimeter frame having a plurality of spaced, angled louvers extending between opposing upright margins of the frame. One or more groups of adjacent louvers include an elongated mirrored strip adhesively attached onto the outwardly facing surface of each louver in the group. An elongated beaded decorative molding is adhesively attached onto the outwardly facing surface of one or more other groups of adjacent louvers so that, in the preferred embodiment, all of the louvers are decorated in alternating groups of mirrored strips and decorative beaded moldings.

It is therefore an object of this invention to provide a decorative louvered door which includes groups of adjacent mirrored louvers alternately positioned between groups of decoratively beaded louvers extending over at least a portion of the otherwise conventional unornamental louvers of the door.

It is yet another object of this invention to provide a method of ornamentally decorating a conventional louvered door.

It is yet another object of this invention to provide a kit for ornamentally decorating a conventional louvered door.

In accordance with these and other objects which will become apparent hereinafter, the instant invention will now be described with reference to the accompanying drawings.

DETAILED DESCRIPTION OF THE INVENTION

Figures 1, 2:
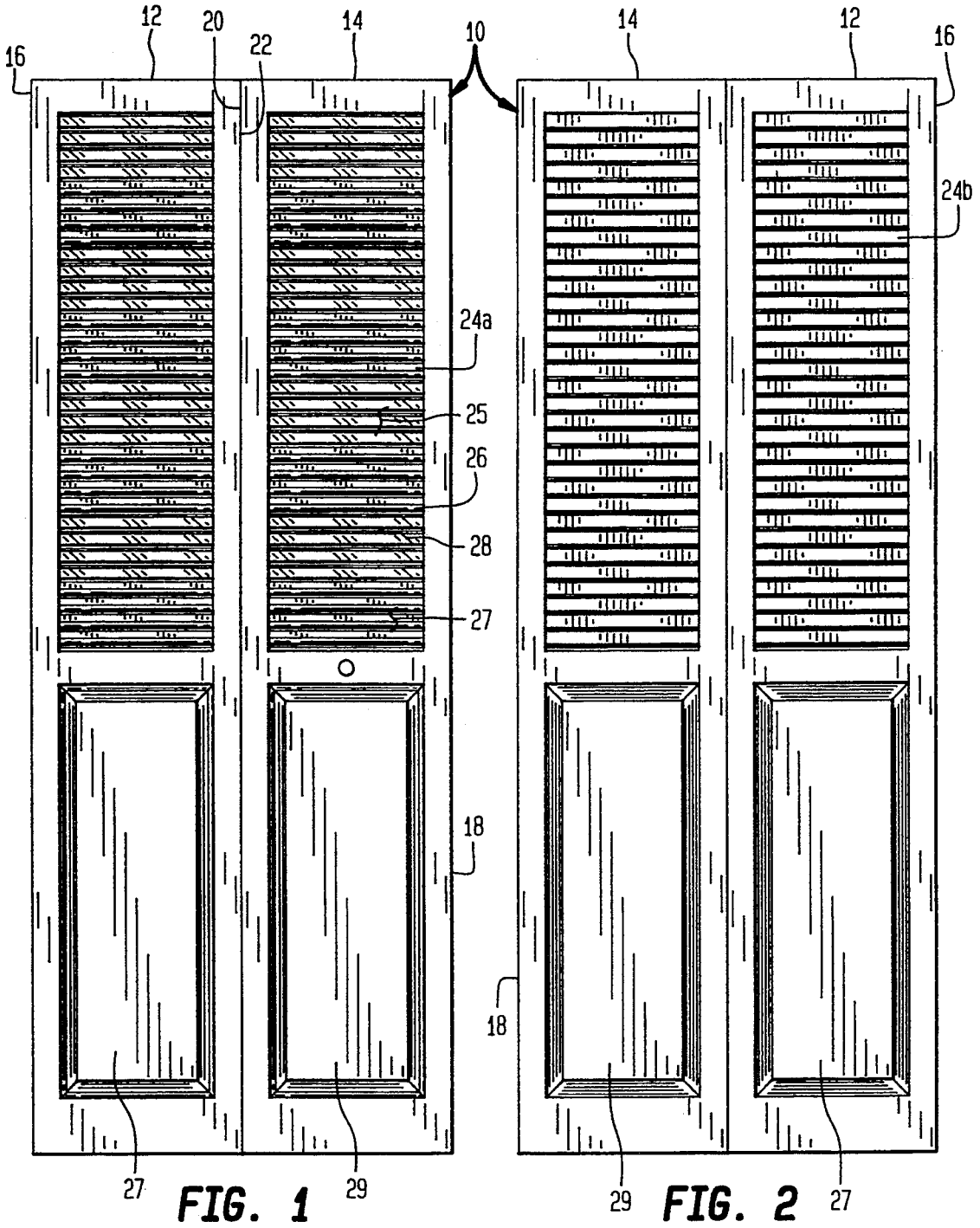
FIG. 1 is a front elevation view of one embodiment of the invention.
FIG. 2 is a rear elevation view of FIG. 1.

Referring now to the drawings, and particularly to FIGS. 1, 2, 5 and 6, one embodiment of the invention is shown generally at numeral 10 and includes a pair of louvered doors 12 and 14. Each of these louvered doors 12 and 14 is typically fabricated of wooden components, including a rectangular perimeter frame having an outer upright margin or stile 16 and 18, respectively, which is connectable to a door jamb (not shown) and inner upright frame margins or stiles 20 and 22, respectively, which meet together when the doors 12 and 14 are in a closed position as shown.

Figure 6:
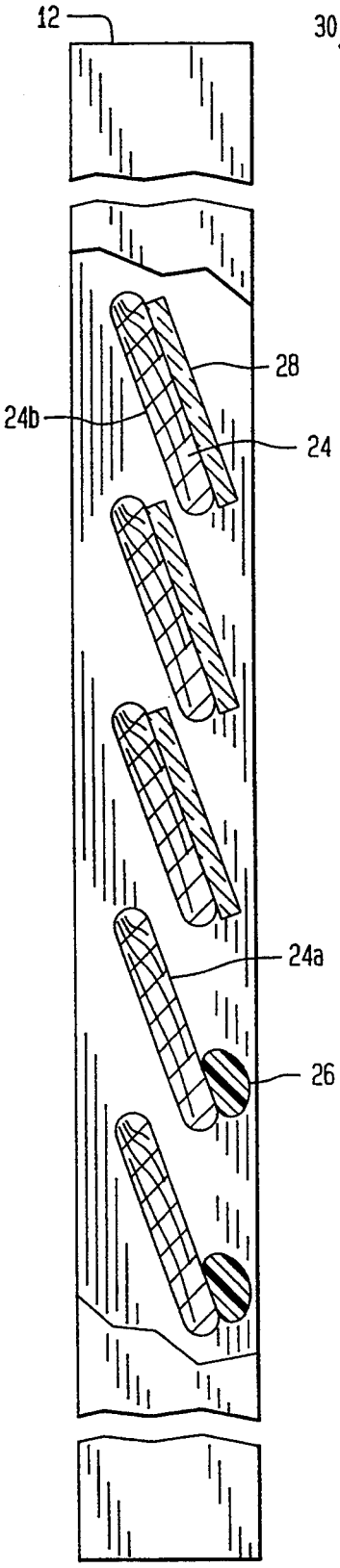
FIG. 6 is a side elevation broken section view of FIG. 1.

Each of these louvered doors 12 and 14 includes a lower solid panel or mullion 27 and 29, respectively, and a plurality of elongated spaced apart rectangular, flat louvers 24 which are connected in diagonal orientation as best seen in FIG. 6 extending horizontally between the upright perimeter frame margins or stiles of each door 12 and 14. These louvers 24 are angled and spaced so that the doors 12 and 14 are not of a "see through" nature, but will nonetheless allow air to pass therethrough for ventilating purposes.

The rear or inward surfaces **24*b* of the louvers 24 as seen in FIG. 2 are unornamental. However, the front or outward surfaces 24*a* of the louvers 24 as seen in FIG. 1** are ornamental in nature as described herebelow.

One or more groups 25 of adjacent louvers 24 include an elongated rectangular mirror 28 adhesively connected by double-sided adhesive tape onto the outwardly surface **24*a* of each louver 24. These mirror strips 28, $\frac{1}{8}$" in thickness, are generally of a length and width similar to that of each louver 24. Each louver group 25 which includes the mirrored strip 28 thereon may include one or more louvers 24 and may be separated per design choice as best seen typically in FIGS. 1 and 5**.

Figure 5:
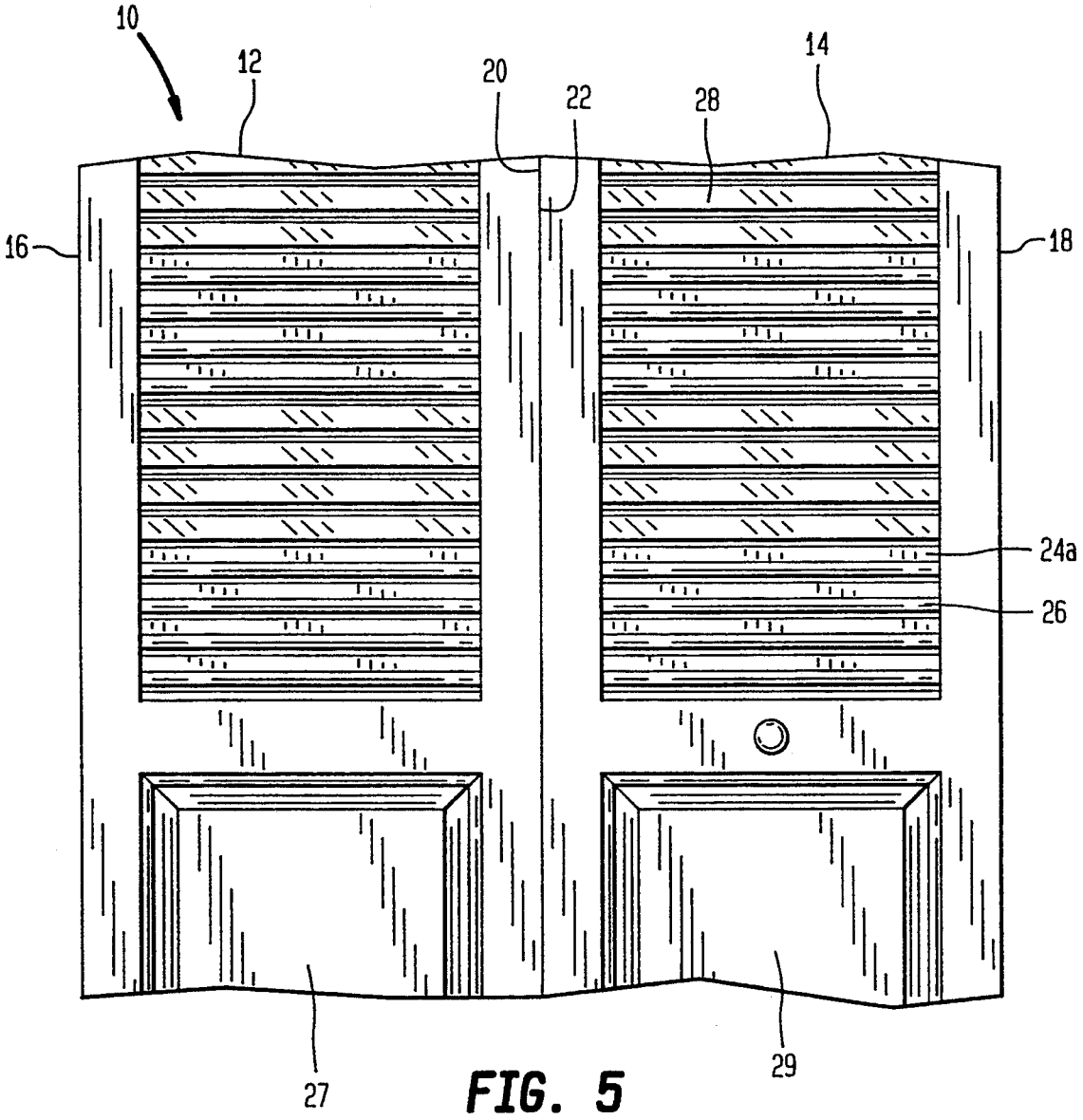
FIG. 5 is an enlarged view of a portion of FIG. 1.

Another group 27 of adjacent louvers 24 includes a metalized decorative bead-shaped molding strip 26 adhesively connected as by double-sided adhesive tape along a lower margin of each louver 24 of that group of louvers 27 as best seen in FIGS. 1 and 5. These beaded molding strips 26 are of a length similar to that of each louver 24 having a highly polished reflective surface for enhanced decorative effect. Such beaded moldings are typically used on automobile exteriors as provided by Cowles Products Company, Inc. of New Haven, Conn. in a preferred size of 3/16 inch in width. The preferred polished reflective color is gold to be in accented decorative contrast with the group of mirrored covered louvers.

In the preferred embodiment, alternate groups of mirrored louvers 25 are spaced apart by alternate groups of louvers 27 having beaded moldings connected along their length. This alternating array of mirrored and beaded louvers extends over all of the louvers 24 of each door 12 and 14.

Figure 3:
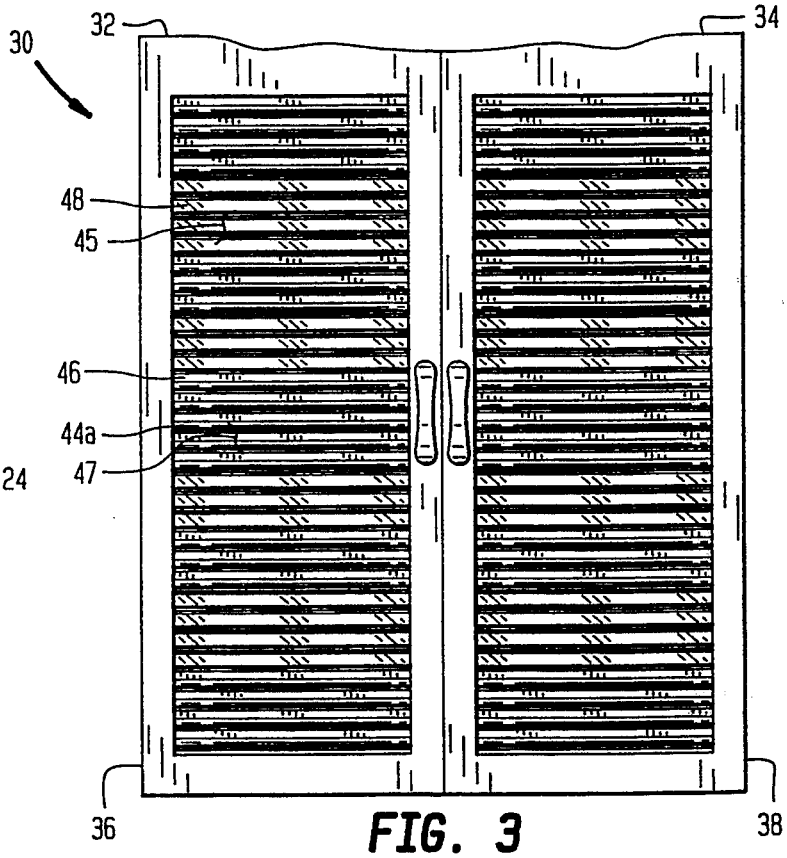
FIG. 3 is a front elevation view of another embodiment of the invention.
Figure 4:
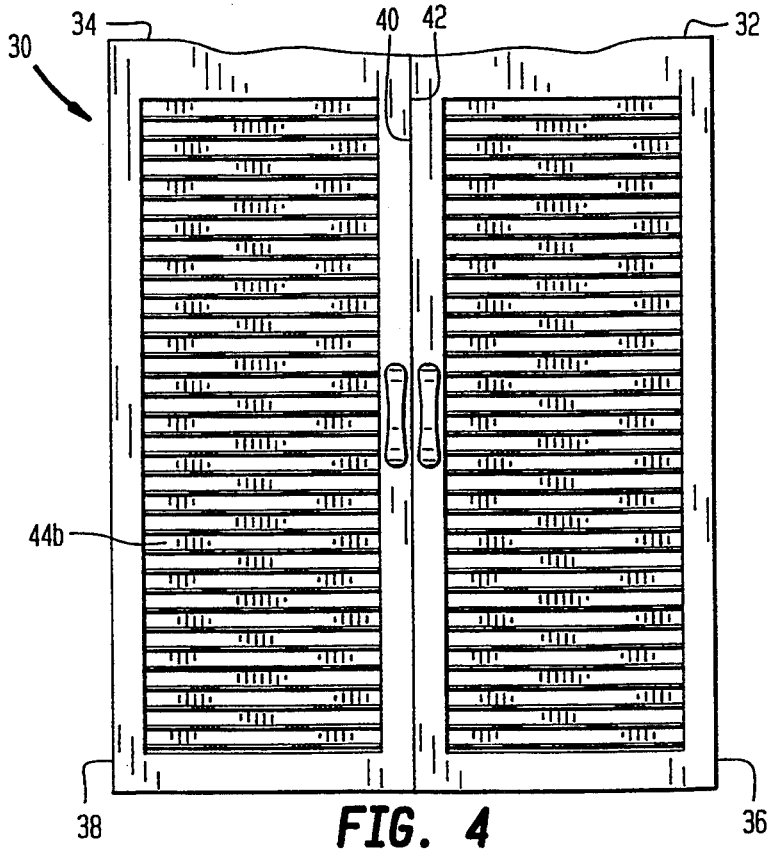
FIG. 4 is a rear elevation view of FIG. 3.

Another embodiment of the invention is shown in FIGS. 3 and 4 generally at numeral 30 and includes a pair of cafe-type louvered doors 32 and 34 having a perimeter frame with an outer frame margin, or stile, 36 and 38, respectively, connectable to a door jamb (not shown). Here, again, the louvered cafe-type doors 32 and 34 meet along inner frame margins 40 and 42 when the doors 32 and 34 are closed.

As previously described, alternating groups 45 of adjacent louvers 44 have their outer surfaces 44*a* covered with mirrored strips 48 of equal size, while another group 47 of alternating louvers 44 include adhesively connected decorative bead-shaped moldings 26 along their lower margins as previously described and shown in FIG. 6. Again, the inner surfaces 44*b* of the louvers 44 of each cafe-type door 32 and 34 remain unornamental as seen in FIG. 4.

It is envisioned that this invention include not only the article of manufacture in the form of a decorative louvered door as shown in the figures, but also the method of ornamentally decorating the louvers of a conventional louvered door by the attachment of mirror strips and/or highly reflective beaded moldings as described, as well as a kit for doing so. The kit includes a quantity of mirror strips 28 or 48 and/or decorative beaded moldings 26 or 46 as above described, along with instructions as to how to adhesively apply these components onto the louvers of a conventional louvered door.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A decorative louvered door comprising:

a frame defining a perimeter of said door;

a plurality of parallel evenly spaced elongated rectangular flat louvers connected in uniformly angled orientation one to another and extending horizontally between opposing spaced upright margins of said frame;

an elongated rectangular mirror adhesively connected onto an outwardly facing surface of each of a first group of adjacent louvers of said plurality of louvers.

2. A decorative louvered door as set forth in claim 1, further comprising:

an elongated decorative beaded molding having a highly reflective polished surface adhesively connected onto an outwardly facing surface of a second group of adjacent louvers of said plurality of louvers, said second group being different than said first group.

3. A decorative louvered door as set forth in claim 2, wherein:

said first and second groups alternate one to another over said plurality of louvers.

4. A method of ornamentally decorating a louvered door which includes a frame defining a perimeter of said door and a plurality of parallel evenly spaced elongated rectangular flat louvers connected in uniformly angled orientation one to another and extending horizontally between opposing spaced upright margins of said frame, comprising the steps of:

A. adhesively attaching an elongated rectangular mirror onto an outwardly facing surface of each of a first group of adjacent louvers of said plurality of louvers.

5. A method as set forth in claim 4, further comprising the step of:

B. adhesively attaching an elongated decorative beaded molding having a highly reflective polished surface onto an outwardly facing surface of a second group of adjacent louvers of said plurality of louvers, said second group being different than said first group;

said first and second groups alternating one to another over said plurality of louvers.

6. A kit for ornamentally decorating a louvered door which includes a frame defining a perimeter of said door and a plurality of parallel evenly spaced elongated rectangular flat louvers connected in uniformly angled orientation one to another and extending horizontally between opposing spaced upright margins of said frame, said kit comprising:

an elongated rectangular mirror adhesively connectable onto an outwardly facing surface of each of a first group of adjacent louvers of said plurality of louvers; and an elongated beaded decorative molding having a highly reflective polished surface adhesively connectable onto an outwardly facing surface of a second group of adjacent louvers of said plurality of louvers, said second group being different than said first group.

* * * * *